United States Patent [19]

Heinzer et al.

[11] 4,215,520

[45] Aug. 5, 1980

[54] APPARATUS FOR MAKING, FILLING, CLOSING AND BOXING BAGS

[75] Inventors: Hans Heinzer, Beringen; Werner Müller, Neuhausen am Rheinfall, both of Switzerland

[73] Assignee: SIG Schweizerische Industrie-Gesellschaft, Neuhausen am Rhienfall, Switzerland

[21] Appl. No.: 959,226

[22] Filed: Nov. 9, 1978

[30] Foreign Application Priority Data

Nov. 9, 1977 [CH] Switzerland ..... 13667/77

[51] Int. Cl.[2] ..... B65B 9/08; B65B 43/42

[52] U.S. Cl. ..... 53/173; 53/552

[58] Field of Search ..... 53/170, 171, 173, 175, 53/449, 551, 552

[56] References Cited

U.S. PATENT DOCUMENTS

| | | | |
|---|---|---|---|
| 3,335,540 | 8/1967 | Reil et al. | 53/551 X |
| 3,774,509 | 11/1973 | Heinzer | 53/175 X |
| 4,084,390 | 4/1978 | Schmachtel et al. | 53/171 X |
| 4,129,976 | 12/1978 | Grundler | 53/552 |

*Primary Examiner*—Travis S. McGehee

*Attorney, Agent, or Firm*—Spencer & Kaye

[57] ABSTRACT

An apparatus for making, filling, closing and boxing bags includes a vertically oriented hollow mandrel about which a hose of sealable sheet is continuously formed, a device for cylindrically providing a transverse seam on the hose; a cutting device for cyclically severing the hose at the transverse seam for providing precedingly filled, sealed bags; a base plate situated underneath the mandrel for supporting thereon serially positioned and advanced, upright-oriented bag-receiving boxes open at their top and bottom; an opening provided in the base plate and aligned with the mandrel; and a vertically displaceably supported bag grasping device for penetrating through the opening into a box positioned underneath the mandrel and for downwardly pulling a filled and closed bag into the box.

7 Claims, 6 Drawing Figures

2
1
7
8
3
5
4
5
4
13
15
15
11b
11a
13
11a
14
13
31
19
20
18
17
6
10
35
29
31
30
29₁
32
28
32

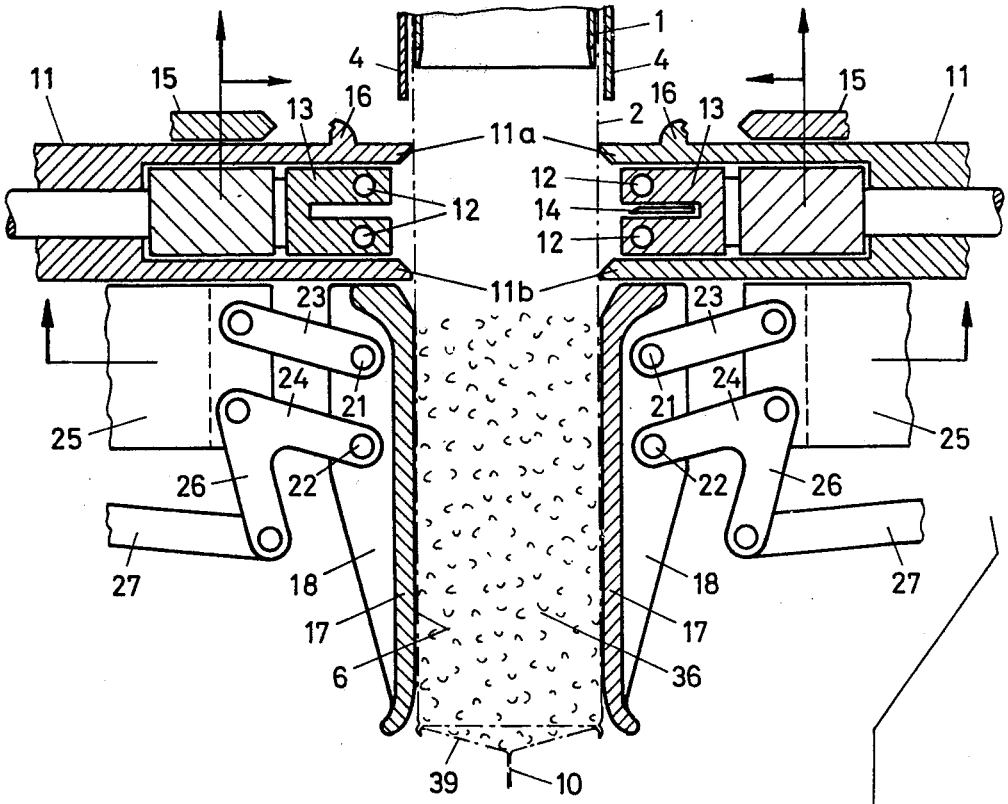
Fig. 3
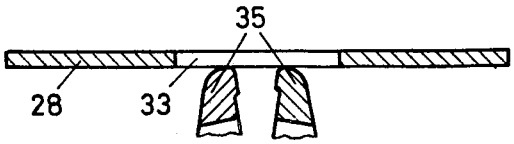

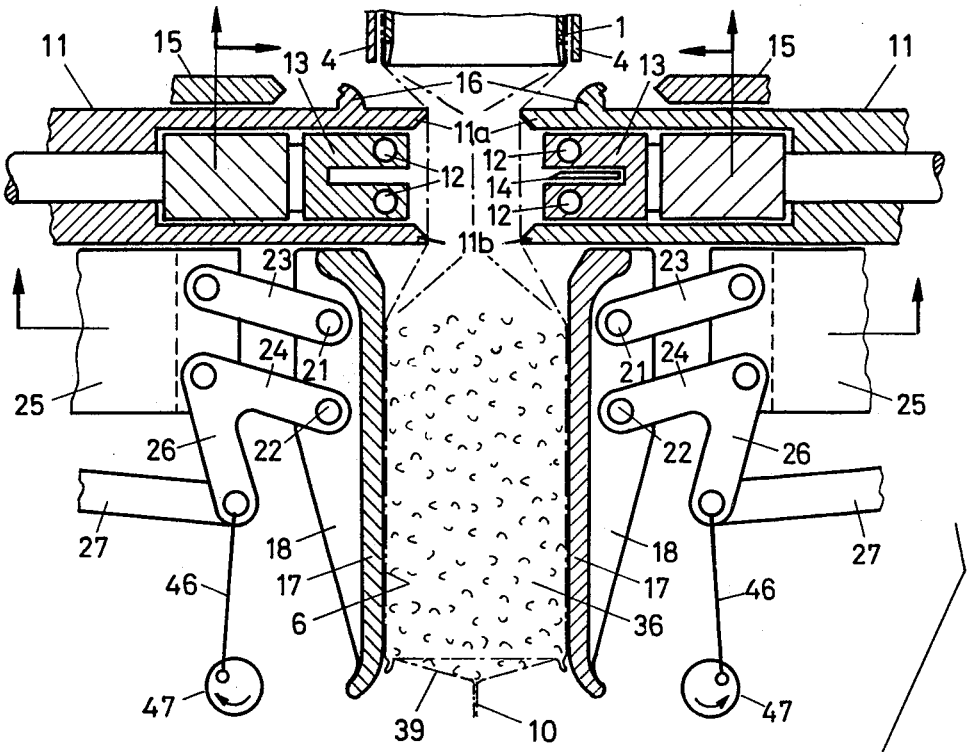
Fig. 4
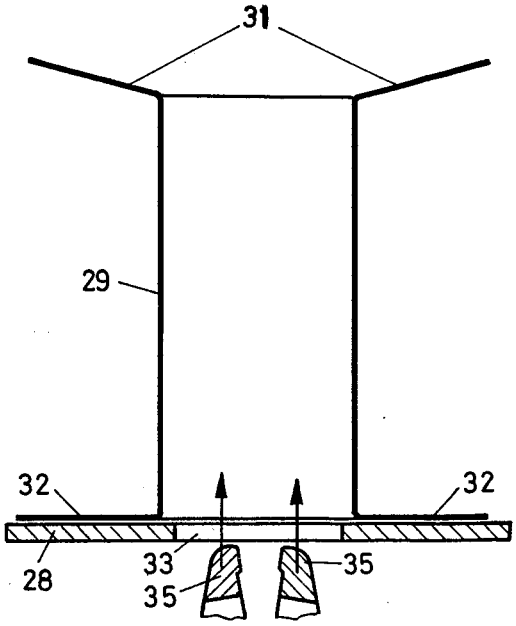

APPARATUS FOR MAKING, FILLING, CLOSING AND BOXING BAGS

BACKGROUND OF THE INVENTION

This invention relates to an apparatus for making, filling closing and packaging (boxing) bags. The apparatus, by means of a hollow mandrel, forms a hose of sealable sheet material into which the goods are poured and thereafter transverse seams are provided which are subsequently cut through to divide the hose into filled bags.

In known apparatuses of the above-outlined type, the filled, separated and sealed bag is allowed to drop or is pushed into a cardboard box. The duration of the fall of the bag is relatively long because of a substantial air resistance which is generated due to the closed bottom of the box. Further, it is disadvantageous to push the bag into the box, because the otherwise present bulge of the bag is increased which may adversely affect the operational reliability of the apparatus. Further, the result of bulging bags is a poor utilization of the volume of the box, that is, the box is unnecessarily large in relation to its contents.

A positioning of empty bags in a container, as disclosed in Swiss Pat. No. 542,701 to which corresponds U.S. Pat. No. 3,774,509, has the disadvantage that an additional filling station is necessary. If, on the other hand, only the bag is made, filled and closed as disclosed in U.S. patent application Ser. No. 835,426, filed Sept. 21, 1977, now U.S. Pat. No. 4,129,976, a particular packing (boxing) station has to be provided in case the bag is to be positioned in an additional protective box.

SUMMARY OF THE INVENTION

It is an object of the invention to provide an improved apparatus of the above-outlined type from which the discussed disadvantages are eliminated.

This object and others to become apparent as the specification progresses, are accomplished by the invention, according to which, briefly stated, the apparatus for making, filling, closing and boxing bags includes a vertically oriented, hollow mandrel about which a hose of sealable sheet is continuously formed, a device for cyclically providing a transverse seam on the hose; a cutting device for cyclically severing the hose at the transverse seam for providing precedingly filled, sealed bags; a base plate situated underneath the mandrel for supporting thereon serially positioned and advanced, upright-oriented bag-receiving boxes open at their top and bottom; an opening provided in the base plate and aligned with the mandrel; and a vertically displaceably supported bag grasping device for penetrating through the opening into a box positioned underneath the mandrel and for downwardly pulling a filled and closed bag into the box.

Since the package container (box) is open at the bottom, no air resistance is generated as the filled bag is introduced thereinto. The drawing of the filled bag into the box by the bag grasping device may be effected very rapidly and further, a bulging of the bag is decreased rather than increased by the pulling effect; thus, the bag is, in fact stretched. In this manner, the degree to which the boxes can be filled with the bags is also increased.

According to a further advantageous feature of the invention, there are additionally provided lateral support plates for the bags and shrouding plates for partially surrounding the hose to effectively prevent a bulging of the individual bags and the hose, respectively.

BRIEF DESCRIPTION OF THE DRAWINGS

FIGS. 2 through 6 are sectional side elevational views of the preferred embodiment, showing the structure in different operational positions.

DETAILED DESCRIPTION OF THE PREFERRED EMBODIMENT

Figure 1:
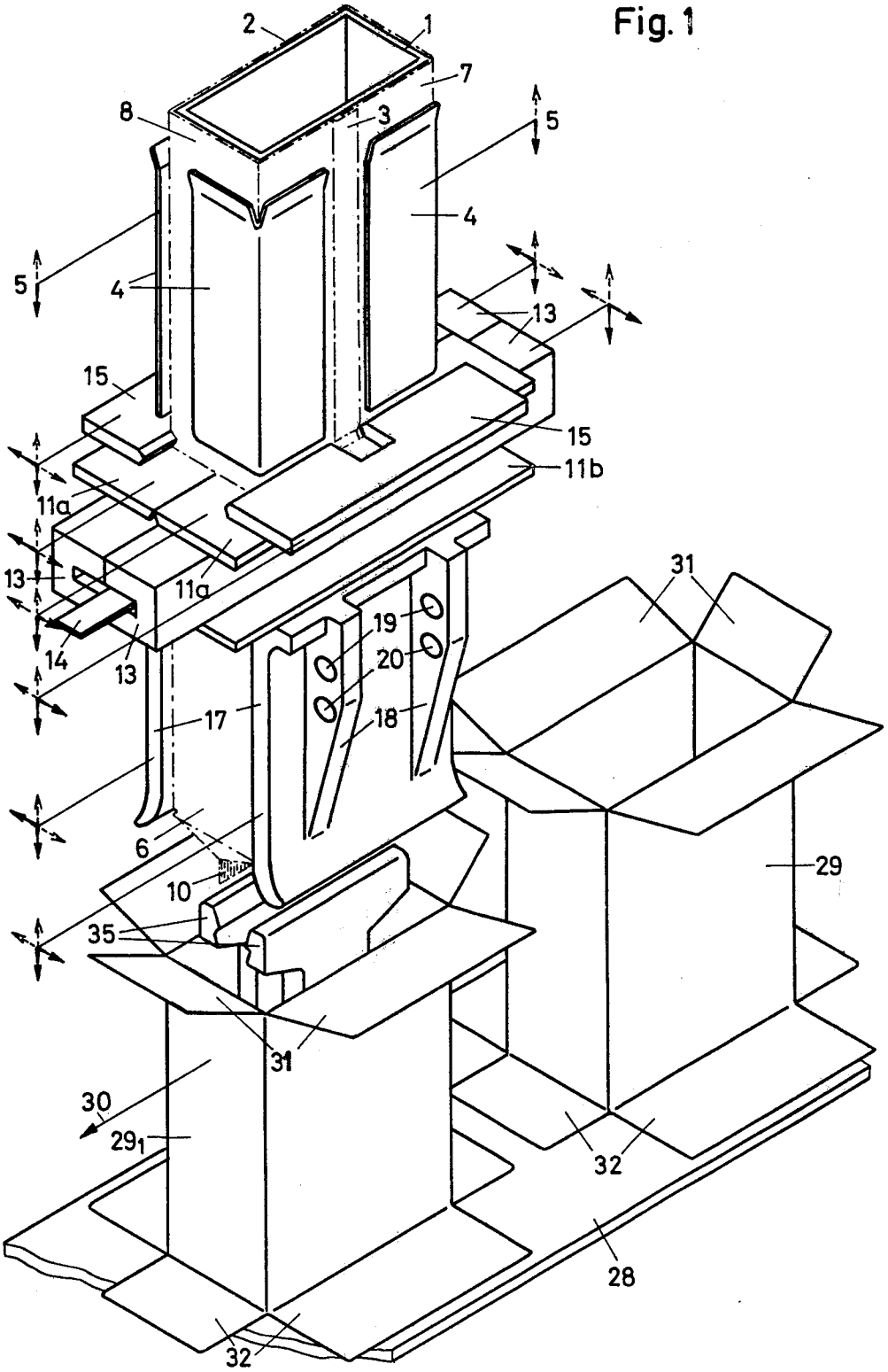
FIG. 1 is a perspective view of some components of a preferred embodiment.

Turning now to FIG. 1, there are shown essential components of the apparatus for forming, filling, closing and boxing bags. The position of the components depicted in FIG. 1 does not, as a whole, correspond to a particular operational position, but is chosen to make the individual components easily recognizable in the Figure.

Thus, the apparatus according to the invention has a hollow mandrel 1 of rectangular cross section with which a hose 2 is formed in a known manner by feeding thereabout a sealable sheet material in a stepwise manner. In all the Figures, the sheet material is illustrated with dash-dot lines for the purpose of better distinguishing it from the actual components of the apparatus. The longitudinal sheet edges are bonded to one another by forming, again with known means, a folded-over longitudinal seam 3.

The hose 2 is partially shrouded by angled plate members 4 which are movable vertically up and down in the direction of the arrow 5 and which serve for supporting externally the hose 2 in order to prevent a bulging effect that might be caused by the contents.

It is noted that the full-line arrows associated with the individual components in FIG. 1 illustrate their momentary condition of motion, whereas the broken-line arrows indicate the corresponding motions of the respective component in the opposite direction.

Figure 2:
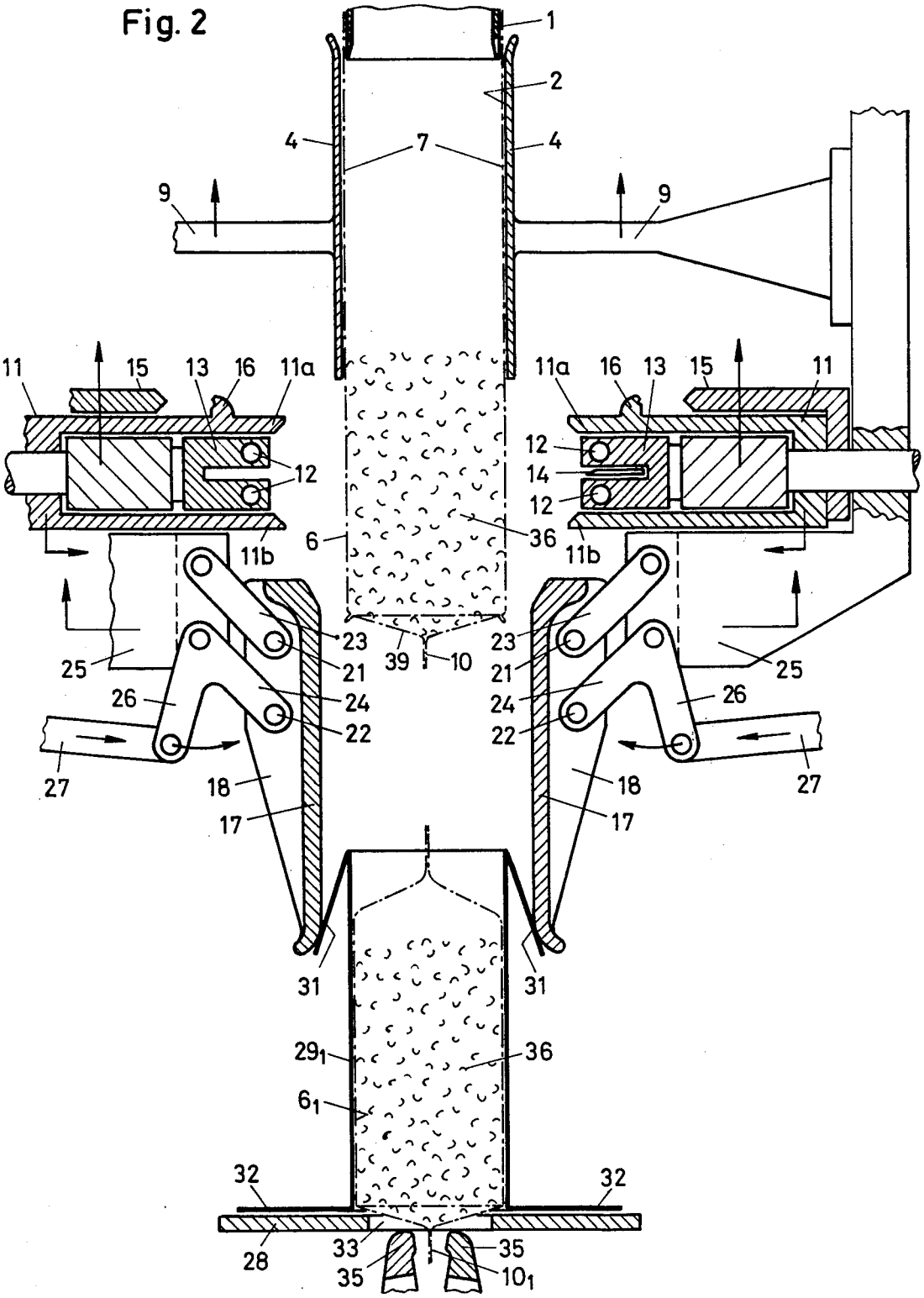

The support plates 4 cover the major part of the two wide sides 7 of the hose 2 and, due to their angled configuration, extend partially over the small sides 8 as well. As seen in FIG. 2, the support plates 4 are provided with arms 9 to which the forces for raising and lowering the support plates 4 are imparted. In the position depicted in FIG. 2, the support plates 4 are positioned still under the lower end of the hollow mandrel 1 and support the wide sides 7 of the bag 6. The bottom of the bag 6 has been closed in a preceding operational cycle and has been provided with a downwardly projecting bottom seam 10.

The apparatus further has a clamping assembly formed, on opposite sides of the traveling path of the hose 2, by an upper clamping shoe **11*a* and a lower clamping shoe 11*b*, which project, in a parallel-spaced relationship to one another, from a common body 11. The upper clamping shoes 11*a* as well as the lower clamping shoes 11*b* are aligned with one another. Between the upper and lower clamping shoes 11*a*, 11*b* attached to the same common body 11, there is arranged—for horizontal displacement—a heating shoe 13 in which respective heating rods 12 are embedded. In a slot provided in the one heating shoe 13 there is movably arranged a knife 14. Above the upper clamping shoes 11*a* there are arranged, for displacement in opposite directions, two clamping strips 15 which cooperate with clamping lugs 16 projecting from the top side of each upper clamping shoe 11***a*.

The apparatus further includes two facing support plates 17 each provided with two vertically oriented, parallel ribs 18 which have upper holes 19 and lower holes 20. Linkages 23 of identical dimension are articulated to each support plate 17 by means of pins 21 passing through the holes 19, while bell crank levers 24 of identical dimension are pivotally attached to each support plate 17 by means of pins 22 passing through the holes 20. The mid portion of each bell crank lever 24 as well as the end of each linkage 23 is, for each plate 17, articulated to separate carriages 25 which can be vertically reciprocated. The bell crank levers 24 have arms 26 which are articulated to respective pull rods 27 with which the bell crank levers 24 can be pivoted. As the bell crank levers pivot about their articulation to the respective carriage 25, the support plates 17 execute a horizontal motion while retaining their vertical orientation, because of the parallelogram arrangement of the members 23 and 24.

Figure 5:
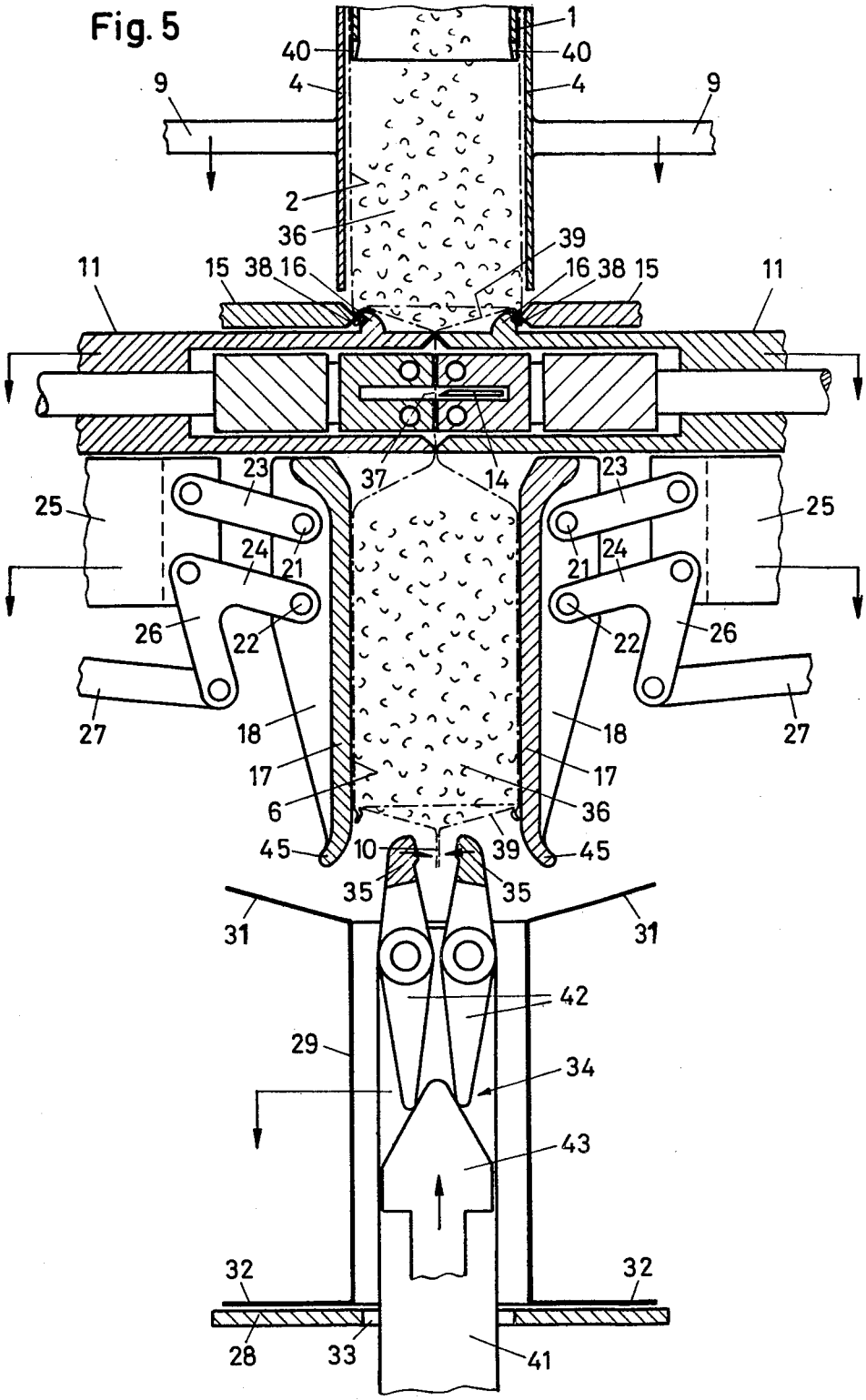
Figure 6:
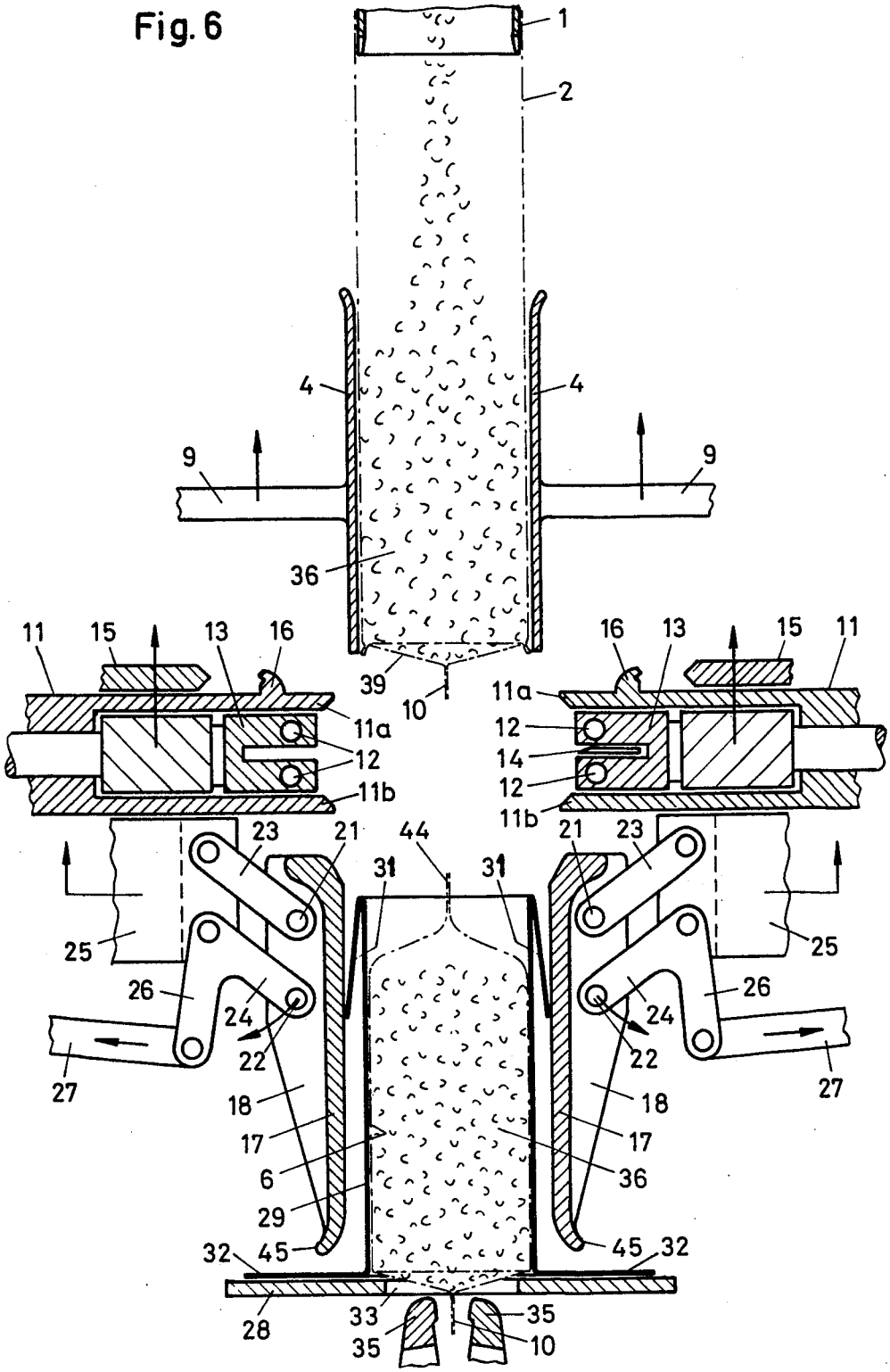

Cardboard boxes 29 are advanced intermittently by a conveyor device (not shown) in the direction of the arrow 30 (FIG. 1) on a base plate 28 extending horizontally beneath the support plates 17. The boxes 29 have open flaps 31 and 32 at their top and bottom, respectively. The base plate 28 has a rectangular opening 33 which is aligned with the mandrel 1 and through which a clamping jaw assembly 34 may project (FIG. 5). In FIG. 2 there are shown only the tips of the cooperating clamping jaws 35 which have just released the bottom seam $\mathbf{10}_1$ of the filled bag $\mathbf{6}_1$ after having drawn the bag $\mathbf{6}_1$ into the box $\mathbf{29}_1$. The vertically movable carriages 25 are connected, by means of the arms 9, with the support plates 4 and further, with the clamping and heating assemblies 11–16. This interconnection ensures that the support plates 4, the support plates 17 and the clamping and heating assemblies 11–16 move vertically in unison.

As the components execute a displacement in the direction of the respective arrows shown in FIG. 2, they assume a position illustrated in FIG. 3. The support plates 4 have now been, to the greatest part, pushed over the hollow mandrel 1. The clamping shoes 11*a* and 11*b* have just arrived into engagement with the hose 2 and the support plates 17 have been moved towards one another and thus have grasped the bag 6 provided with the bottom seam 10. The bag 6 has been previously charged with the goods 36 which have fallen into the bag after the bottom seam has been provided. The filling operation is performed in a known manner, such as disclosed, for example, in U.S. patent application Ser. No. 835,426, now U.S. Pat. No. 4,129,976. The filled bag $\mathbf{6}_1$ positioned in the box $\mathbf{29}_1$ has already been further advanced. The closing flaps 31 and 32 are, in a further station of the box conveying apparatus, brought into their closed position in a simple manner and subsequently glued. In particular cases flapless containers may be utilized for for packaging the bags 6.

Turning now to FIG. 4, in the subsequent operational position depicted therein, the clamping shoes 11*a* and 11*b* have been moved inwardly and thus pinch the hose 2 in preparation for the successive inward motion of the heating shoes 13, which produce a wide transverse seam 37 shown in FIG. 5. Between the operational phases depicted in FIGS. 4 and 5, the support plates 4 and the clamping and heating assemblies 11–16 have moved further upwardly and inwardly and thus two edge folds 38 of the bag bottom 39 formed by the shoes 11*a* and 13 are firmly clamped between the clamping strips 15 and the clamping lugs 16. To allow such an engagement, at the lower end of the hollow mandrel 1 there are provided two aligned openings 40. The cutouts 40 in the hollow mandrel 1 are necessary, in order that the clamping lugs 16 and the clamping strips 15 may grasp the hose 2 next to the cutouts 40 immediately after the operational phase depicted in FIG. 4. Thus the edge folds 38 are formed and subsequently the bag 6 is pulled downwards.

In the U.S. patent application Ser. No. 835,426, FIG. 4, discloses a similar operational engagement of the opening 25 in the mandrel 3 with the clamping fingers 23 and the recess 28 for forming the edge folds 27. Then, during the successive doward motion of the carriages 25, the hose 2 is pulled downwardly into the position shown in FIG. 5. FIG. 5 illustrates that the bag grasping device 34 has been moved upwardly through the opening 33 provided in the base plate 28.

The bag grasping device 34 has two levers 42 which form the clamping jaws 35 and which are articulated to a vertically displaceable holder plate 41. The bag grasping device further has a control wedge 43, which, when it is moved upwardly with respect to the holder plate 41, spreads apart the lower ends of the levers 42 thus causing a closing of the clamping jaws 35. The clamping jaws 35 grasp the bottom seam 10 of the filled bag 6 and pull the latter into the upwardly and downwardly open box 29 as the carriages 25 move further downwardly.

Before the bag 6 is entirely pulled into the box 29, the knife 14 is actuated and, as a result, the transverse seam 37 is cut through, whereupon there are formed a new bottom seam 10 for the leading end of the hose 2 and a head seam 44 for the filled bag 6 separated from the hose 2. Subsequent to severing the transverse seam 37, the clamping and heating assemblies 11–16 are moved away from one another and, by actuating the pull rods 27, the support plates 17 have likewise released the bag 6 and are, in a loose condition, pushed downwardly over the box 29, causing a downward folding of the upper box flaps 31. In order to facilitate this step, the support plates 17 are provided at their lower portion with a flared run-in part 45.

The support plates 17 prevent a bulging of the wide sides 7 of the bags 6; such a bulging would hinder the introduction of the bags into the box 29. In order to enhance and accelerate the filling operation, it is advantageous to impart a vibration to the support plates 17. This vibration which is transmitted to the bag 6, can be effected in different ways; one such solution is schematically illustrated in FIG. 4. According to the arrangement shown in FIG. 4, the arm 26 of each ball crank lever 24 is articulated to a rod 46 which is vertically reciprocated by means of a rapidly rotating crank disc 47, thus causing a rapid vibration of the support plates 17.

It is to be understood that the above description of the present invention is susceptible to various modifications, changes and adaptations, and the same are intended to be comprehended within the meaning and range of equivalents of the appended claims.

We claim:

1. In an apparatus for making, filling, closing and boxing bags including a vertically oriented hollow mandrel about which a hose of sealable sheet is continuously formed, means for cyclically providing a transverse seam on the hose; and cutting means for cyclically severing the hose at the transverse seam for providing precedingly filled, sealed bags; the improvement comprising (a) a base plate situated underneath said mandrel for supporting serially positioned and advanced, upright-oriented bag-receiving boxes open at their top and bottom;

(b) means defining an opening provided in said base plate and aligned with said mandrel;

(c) vertically displaceably supported bag grasping means for penetrating through said opening into a box positioned underneath said mandrel and for downwardly pulling a filled and closed bag into the box;

(d) two face-to-face oriented support plates situated underneath the transverse seam-providing means and the cutting means for supporting opposite sides of the filled bags; and (e) means for vertically displacing in unison said support plates, said transverse seam-providing means and said cutting means and for horizontally displacing said support plates towards and away from one another; the means for vertically and horizontally displacing each support plate including (1) a vertically displaceable carriage;

(2) a parallelogram linkage connecting each said support plate to the respective carriage to provide for the vertical displacement of each said support plate; and (3) actuating means connected to the linkage to provide for the horizontal displacement of each said support plate.

2. In an apparatus for making, filling, closing and boxing bags including a vertically oriented hollow mandrel about which a hose of sealable sheet is continuously formed, means for cyclically providing a transverse seam on the hose; and cutting means for cyclically severing the hose at the transverse seam for providing precedingly filled, sealed bags; the improvement comprising (a) a base plate situated underneath said mandrel for supporting serially positioned and advanced, upright-oriented bag-receiving boxes open at their top and bottom;

(b) means defining an opening provided in said base plate and aligned with said mandrel;

(c) vertically displaceably supported bag grasping means for penetrating through said opening into a box positioned underneath said mandrel and for downwardly pulling a filled and closed bag into the box;

(d) two face-to-face oriented, vertically and horizontally movable support plates situated underneath the transverse seam-providing means and the cutting means for supporting opposite sides of the filled bags; each support plate having, at a lower end, a flaring run-in portion for facilitating introduction of the box between said support plates during downward motion thereof;

(e) means for vertically displacing in unison said support plates, said transverse seam-providing means and said cutting means; and (f) means for horizontally displacing said support plates towards and away from one another.

3. An apparatus as defined in claim 1 or 2, wherein said support plates are first support plates, further comprising at least two face-to-face oriented second support plates situated above the transverse seam-providing means and the cutting means for supporting opposite sides of the hose.

4. An apparatus as defined in claim 1 or 2, further comprising means for imparting a vibration to said support plates.

5. An apparatus as defined in claim 1 or 2, further comprising sheet clamping means situated above the transverse seam-providing means and the cutting means for forming edge folds in the leading end of the hose and for pulling the hose downwardly over said mandrel.

6. An apparatus as defined in claim 5, wherein said sheet clamping means comprises clamping strips cooperating with respective clamping lugs.

7. An apparatus as defined in claim 6, further comprising means defining aligned cutouts in a lower end of said mandrel for cooperating with said clamping strip in forming the edge folds.

* * * * *